US008172515B2

(12) United States Patent
Kawashima et al.

(10) Patent No.: US 8,172,515 B2
(45) Date of Patent: May 8, 2012

(54) TURBO VACUUM PUMP

(75) Inventors: Hiroyasu Kawashima, Tokyo (JP); Shinichi Sekiguchi, Tokyo (JP)

(73) Assignee: Ebara Corporation, Tokyo (JP)

( * ) Notice: Subject to any disclaimer, the term of this patent is extended or adjusted under 35 U.S.C. 154(b) by 596 days.

(21) Appl. No.: 12/365,314

(22) Filed: Feb. 4, 2009

(65) Prior Publication Data

US 2009/0196734 A1 Aug. 6, 2009

(30) Foreign Application Priority Data

Feb. 5, 2008 (JP) ..... 2008-025522

(51) Int. Cl.
*F01D 13/00* (2006.01)
*F03B 15/00* (2006.01)
*F04D 1/10* (2006.01)
*F04D 17/14* (2006.01)

(52) U.S. Cl. ... 415/143; 415/115; 417/324; 417/423.12; 417/423.4

(58) Field of Classification Search ..... 415/115, 415/120, 90, 143, 168.3, 198.1; 417/324, 417/423.12, 423.4
See application file for complete search history.

(56) References Cited

U.S. PATENT DOCUMENTS 7,645,116 B2 * 1/2010 Kawasaki et al. ..... 415/143
7,717,684 B2 * 5/2010 Sekiguchi et al. ..... 417/423.4
7,938,619 B2 * 5/2011 Kawasaki et al. ..... 415/143

FOREIGN PATENT DOCUMENTS

JP 2005-307859 A 11/2005
JP 2007-192076 A 8/2007

* cited by examiner

*Primary Examiner* — David Nhu
(74) *Attorney, Agent, or Firm* — Westerman, Hattori, Daniels & Adrian, LLP

(57) ABSTRACT

A turbo vacuum pump comprising a suction part 23A that sucks gas in an axial direction; a discharge part 50 that discharges the gas sucked by the suction part 23A, the discharge part 50 having a plurality of rotating impellers 70, 80 and a stationary impeller 71 arranged so as to be opposed to each of the plurality of rotating impellers 70, 80; and a rotating shaft 21 that rotates the plurality of rotating impellers 70, 80, wherein the plurality of rotating impellers 70, 80 include at least one stage of a first turbine impeller 70 for discharging the sucked gas in the axial direction, the first turbine impeller 70 being fixed to a suction-part-side end face 15 of the rotating shaft 21, and at least one stage of a second turbine impeller 80 fixed to the rotating shaft 21 that extends through the second turbine impeller 80, the second turbine impeller 80 being arranged downstream of the first turbine impeller 70.

10 Claims, 13 Drawing Sheets

FIG. 8

TABLE

| CASE NUMBER | | 1 | 2 | 3 |
|---|---|---|---|---|
| NUMBER OF STAGES AT SHAFT END | [STAGE] | 7 | 6 | 5 |
| NATURAL FREQUENCY OF ROTATING SHAFT Fs | [Hz] | 1978 | 1771 | 1594 |
| NATURAL FREQUENCY OF ROTOR Fa | [Hz] | 1028 | 1059 | 1070 |

TURBO VACUUM PUMP

BACKGROUND OF THE INVENTION

1. Technical Field

The present invention relates to a momentum transfer type turbo vacuum pump that discharges gas, and more specifically to a turbo vacuum pump suitable for applications in which a large flow of gas is discharged.

2. Related Art

As shown in FIG. 13, a turbo vacuum pump 101 according to the prior art includes a discharge part 150, a motion control part 151, a rotating shaft 121, and a casing 153 that houses the discharge part 150, the motion control part 151, and the rotating shaft 121. The rotating shaft 121 is arranged vertically from top to bottom.

The casing 153 has an upper housing 123, a lower housing 137 arranged below the upper housing 123, and a sub-casing 140 arranged between the upper housing 123 and the lower housing 137. The upper housing 123 has a suction nozzle 123A, and the sub-casing 140 has a discharge nozzle 123B formed on its side face. The upper housing 123 houses the discharge part 150, and the portion of the rotating shaft 121 on the discharge part 150 side. A suction opening 155A is formed in the suction nozzle 123A, and a discharge opening 155B is formed in the discharge nozzle 123B. The suction nozzle 123A sucks gas from the suction opening 155A, and the discharge nozzle 123B discharges the sucked gas from the discharge opening 155B.

The discharge part 150 includes a plurality of (five) stages of stationary impellers 171,128, a turbine impeller part 173 having a plurality of (three) stages of turbine impellers 170, and a plurality of (three) stages of centrifugal impellers (centrifugal drag impellers) 124. The stationary impellers 171 are formed in three stages, and arranged immediately downstream of the respective turbine impellers 170. The stationary impellers 128 are formed in two stages, and arranged immediately downstream of the first and second stages of the centrifugal impellers 124. Gas exiting the turbine impeller 170 of the last stage is sucked into the centrifugal impeller 124 of the first stage.

A hollow part 112 is formed in a boss part 174 of the turbine impeller part 173, and a through hole 158 is formed at a bottom part 112B of the hollow part 112. A screw hole 118 is formed in a suction-part-side end face 115 in the upper portion of the rotating shaft 121. The turbine impeller part 173 is mounted to the suction-part-side end face 115, being fixed with a hexagonal bolt 178. That is, the hexagonal bolt 178 is inserted into the through hole 158 of the turbine impeller part 173, and is further inserted into the screw hole 118 of the rotating shaft 121, thus fixing the turbine impeller part 173 to the suction-part-side end face 115 of the rotating shaft 121 (for example, Patent Document 1: JP-A-2007-192076).

However, in the turbo vacuum pump 101 mentioned above, since the turbine impeller part 173 having the turbine impellers 170 is mounted to the suction-part-side end face 115 of the rotating shaft 121, the natural frequency of the rotor as a whole including the rotating shaft 121, the turbine impeller part 173, and the centrifugal impellers 124 decreases.

Accordingly, it is an object of the present invention to provide a turbo vacuum pump that makes it possible to enhance the natural frequency of the rotor as a whole to perform stable high-speed rotation, and enables high-speed rotation to thereby achieve a reduction in size and weight.

SUMMARY OF THE INVENTION

For the purpose of accomplishing the above object, a 1st aspect of the invention provides a turbo vacuum pump comprising, as shown in FIG. 1 for example, a suction part 23A that sucks gas in an axial direction; a discharge part 50 that discharges the gas sucked by the suction part 23A, the discharge part 50 having a plurality of rotating impellers 70, 80 and a stationary impeller 71 arranged so as to be opposed to each of the plurality of rotating impellers 70, 80; and a rotating shaft 21 that rotates the plurality of rotating impellers 70, 80, wherein the plurality of rotating impellers 70, 80 include at least one stage of a first turbine impeller 70 for discharging the sucked gas in the axial direction, the first turbine impeller 70 being fixed to a suction-part-side end face 15 of the rotating shaft 21, and at least one stage of a second turbine impeller 80 fixed to the rotating shaft 21 that extends through the second turbine impeller 80, the second turbine impeller 80 being arranged downstream of the first turbine impeller 70.

According to the above configuration, the plurality of rotating impellers include at least one stage of a first turbine impeller that is fixed to a suction-part-side end face of the rotating shaft, and at least one stage of a second turbine impeller that is arranged downstream of the first turbine impeller and fixed to a rotating shaft that extends through the second turbine impeller. Thus, as compared with a case where the first turbine impeller and the second turbine impeller are both fixed to the suction-part-side end face of the rotating shaft, the turbo vacuum pump can be constructed such that the weight of an element fixed to the suction-part-side end face of the rotating shaft can be reduced to increase the natural frequency of the rotor as a whole, thereby making it possible to achieve stable high-speed rotation and reduction in size and weight. It should be noted that the rotor includes the rotating shaft, and the plurality of rotating impellers 80-1.

A 2nd aspect of the invention provides the turbo vacuum pump 1 as recited in the 1st aspect of the invention, as shown in FIG. 10 for example, wherein a hollow part 22-1 is formed in an axial direction in a portion of the rotating shaft 21-1 which extends through the second turbine impeller 80-1.

According to the above configuration, since a hollow part is formed in the rotating shaft, the weight of the rotor can be reduced with hardly any decrease in the natural frequency of the rotor.

A 3rd aspect of the invention provides the turbo vacuum pump 1-1 as recited in the 2nd aspect of the invention, as shown in FIG. 10, wherein the hollow part 22-1 has an opening 38-1 that opens at the suction-part-side end face 15-1 of the rotating shaft 21-1, and further comprising a boss 19-1 for fixing the first turbine impeller 70-1 to the rotating shaft 21-1 via the boss 19-1, the boss 19-1 being inserted into the hollow part 22-1 from the opening 38-1.

According to the above configuration, since a boss is provided, by inserting the boss into the hollow part from the opening, the first turbine impeller can be fixed to the rotating shaft via the boss.

A 4th aspect of the invention provides the turbo vacuum pump 1-2 as recited in the 1st aspect of the invention, as shown in FIG. 12 for example, wherein a hollow part 22-1 is formed in the rotating shaft 21-2, the hollow part 22-2 has an opening 38-2 that opens at an end face 17-2 on a side opposite the suction-part-side end face 15-2 of the rotating shaft 21-2, and the opening 38-2 is formed so as not to communicate with the suction-part-side end face 15-2.

According to the above configuration, since a hollow part is formed in the rotating shaft, the weight of the rotor can be reduced with hardly any decrease in the natural frequency of the rotor.

A 5th aspect of the invention provides the turbo vacuum pump 1 as recited in any of the 1st to 4th aspects of the invention, as shown in FIG. 1 for example, wherein the plurality of rotating impellers 70, 80 further include a centrifugal impeller 24 located downstream of the second turbine impeller 80 for further discharging the discharged gas by a centrifugal drag effect.

According to the above configuration, since a centrifugal impeller is provided, the degree of vacuum in the suction part can be increased. Discharging gas by a centrifugal drag effect means discharging gas from the inner periphery side to the outer periphery side in the radial direction of the centrifugal impeller, by the effect of both the viscosity of the gas and the centrifugal force acting on the gas.

For the purpose of accomplishing the above object, a 6th aspect of the invention provides a turbo vacuum pump comprising, as shown in FIG. 10 for example, a suction part 23A-1 that sucks gas in an axial direction; a discharge part 50-1 that discharges the gas sucked by the suction part 23A-1, the discharge part 23A-1 having a plurality of rotating impellers 70-1, 80-1 and a stationary impeller 71-1 arranged so as to be opposed to each of the plurality of rotating impellers 70-1, 80-1; and a rotating shaft 21-1 that rotates the plurality of rotating impellers 70-1, 80-1 and has a hollow part 22-1 formed in an axial direction, wherein the plurality of rotating impellers 70-1, 80-1 include at least one stage of a turbine impeller 70-1 for discharging the sucked gas in the axial direction, the turbine impeller 70-1 being fixed to a suction-part-side end face 15-1 of the rotating shaft 22-1, the hollow part 22-1 has an opening 38-1 that opens at the suction-part-side end face 15-1 of the rotating shaft 21, and further comprising a boss 19-1 for fixing the first turbine impeller 70-1 to the rotating shaft 21-1 via the boss 19-1, the boss 19-1 being inserted into the hollow part 22-1 from the opening 38-1.

According to the above configuration, since a boss is provided, by inserting the boss into the hollow part from the opening, the first turbine impeller can be fixed to the rotating shaft via the boss. Also, since a hollow part is formed in the rotating shaft, the weight of the rotor can be reduced with hardly any decrease in the natural frequency of the rotor.

For the purpose of accomplishing the above object, a 7th aspect of the invention provides a turbo vacuum pump 1-2 comprising, as shown in FIG. 12 for example, a suction part 23A-2 that sucks gas in an axial direction; a discharge part 50-2 that discharges the gas sucked by the suction part 23A-2, the discharge part 50-2 having a plurality of rotating impellers 70-2, 80-2 and a stationary impeller 71-2 arranged so as to be opposed to each of the plurality of rotating impellers 70-2, 80-2; and a rotating shaft 21-2 that rotates the plurality of rotating impellers 70-2, 80-2 and has a hollow part 22-2 formed in an axial direction, wherein the plurality of rotating impellers 70-2, 80-2 include at least one stage of a turbine impeller 70-2 for discharging the sucked gas in the axial direction, the turbine impeller 70-2 being fixed to a suction-part-side end face 15-2 of the rotating shaft 21-2, the hollow part 22-2 has an opening 38-2 that opens at an end face 17-2 on a side opposite the suction-part-side end face 15-2 of the rotating shaft 21-2, and the opening 38-2 is formed so as not to communicate with the suction-part-side end face 15-2.

According to the above configuration, the hollow part has an opening that opens at an end face on the side opposite the suction-part-side end face of the rotating shaft, and the hollow part is formed so as not to extend through the suction-part-side end face of the rotating shaft. Thus, at least one stage of a turbine impeller can be easily and reliably fixed to the suction-part-side end face. Also, since a hollow part is formed in the rotating shaft, the weight of the rotor can be reduced with hardly any decrease in the natural frequency of the rotor.

A 8th aspect of the invention provides the turbo vacuum pump 1-1 as recited in the 6th or 7th aspect of the invention, as shown in FIG. 10 for example, wherein the plurality of rotating impellers 70-1, 80-1, 24-1 further include a centrifugal impeller 70-1, 80-1 located downstream of the turbine impeller 24-1 for further discharging the discharged gas by a centrifugal drag effect.

According to the above configuration, since a centrifugal impeller is provided, the degree of vacuum in the suction part can be increased.

In the turbo vacuum pump of the first invention, the plurality of rotating impellers include at least one stage of a first turbine impeller fixed to a suction-part-side end face of the rotating shaft, and at least one stage of a second turbine impeller fixed to the rotating shaft that extends through the second turbine impeller, the second turbine impeller being arranged downstream of the first turbine impeller. Thus, as compared with a case where the second turbine impeller is fixed to the suction-part-side end face of the rotating shaft, the turbo vacuum pump can be constructed such that the weight of an element fixed to the suction-part-side end face of the rotating shaft can be reduced to increase the natural frequency of the rotor as a whole, thereby making it possible to achieve stable high-speed rotation and reduction in size and weight.

In the turbo vacuum pump of the second invention, since a boss is provided, by inserting the boss into the hollow part from the opening, the first turbine impeller can be fixed to the rotating shaft via the boss. Also, since a hollow part is formed in the rotating shaft, the weight of the rotor can be reduced with hardly any decrease in the natural frequency of the rotor.

The present application is based on the Japanese Patent Application No. 2008-025522 filed on Feb. 5, 2008 in Japan. This Japanese Patent Application is hereby incorporated in its entirety by reference into the present application.

The present application will become more fully understood from the detailed description given hereinbelow. However, the detailed description and the specific embodiment are illustrated of desired embodiments of the present invention and are described only for the purpose of explanation. Various changes and modifications will be apparent to those ordinary skilled in the art of the basic of the detailed description.

The applicant has no intention to give to public any disclosed embodiment. Among the disclosed changes and modifications, those which may not literally fall within the scope of the patent claims constitute, therefore, a part of the present invention in the sense of doctrine of equivalents.

BRIEF DESCRIPTION OF THE DRAWING

FIG. 8 is a table showing the natural frequency Fs of a rotating shaft and the natural frequency Fa of a rotor in each of Cases 1 to 3.

DETAILED DESCRIPTION OF THE PREFERRED EMBODIMENT

Figure 1:
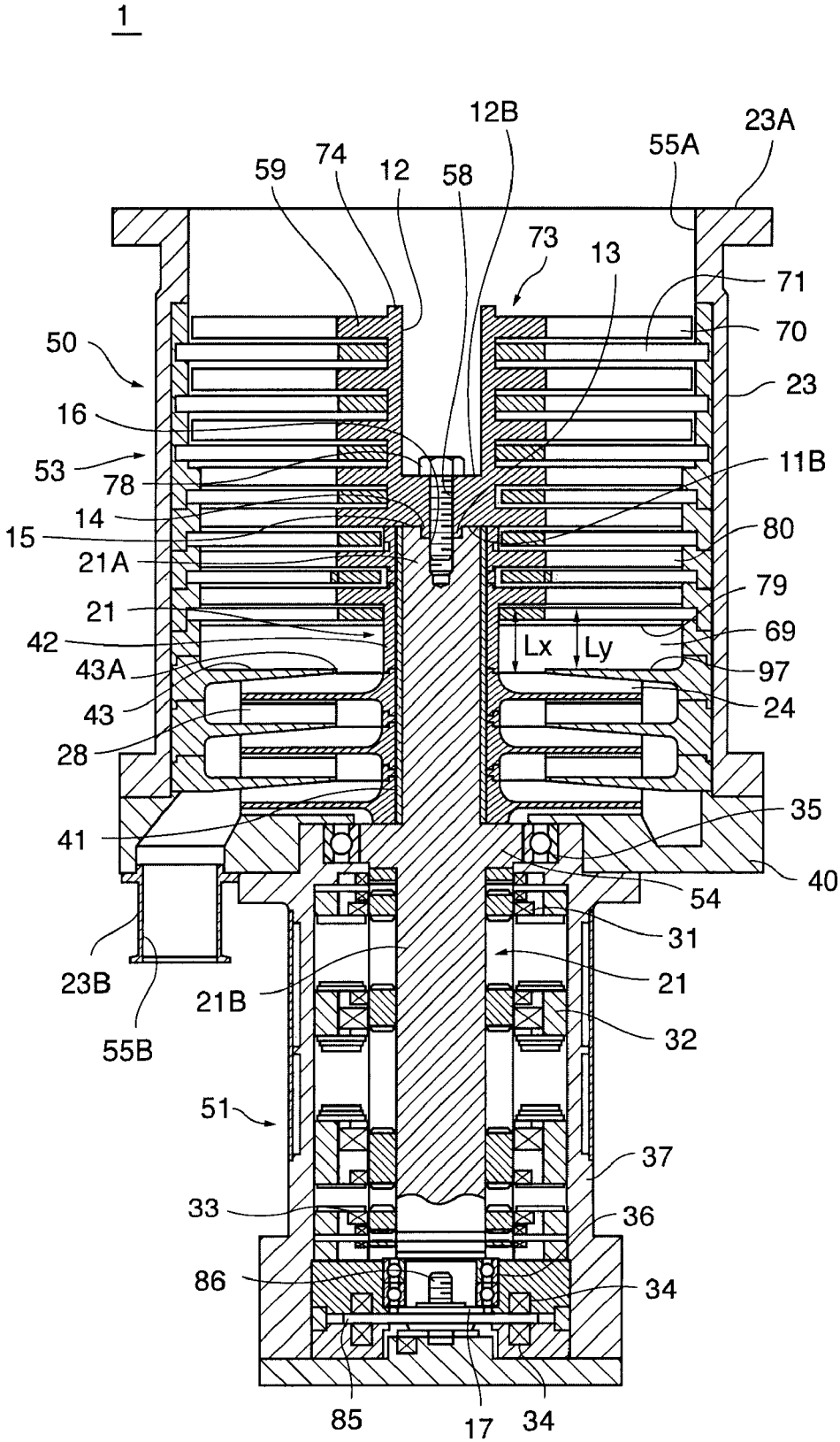
FIG. 1 is a front cross sectional view of a turbo vacuum pump according to a first embodiment of the present invention.

Embodiments of the present invention will be described below with reference to the drawings. It should be noted that in the drawings, the same or corresponding members are denoted by the same reference numerals, and repetitive description will be omitted.

FIG. 1 is a front cross sectional view showing the configuration of a turbo vacuum pump 1 according to a first embodiment of the present invention. In the following, a description will be made with reference to the drawings. The turbo vacuum pump 1 (hereinafter referred to as pump 1 as appropriate) is of a vertical type, and includes a discharge part 50, a motion control part 51, a rotating shaft 21 of a solid shaft structure, and a casing 53 that houses the discharge part 50, the motion control part 51, and the rotating shaft 21. The rotating shaft 21 is arranged vertically from top to bottom, and has a discharge-part-side part 21A on the discharge part 50 side, a motion-control-part-side part 21B on the motion control part 51 side, and a disk-shaped large diameter part 54 arranged between the discharge-part-side part 21A and the motion-control-part-side part 21B.

The casing 53 has an upper housing (pump stator) 23, a lower housing 37 arranged below the upper housing 23 in the vertical direction (axial direction of the pump 1), and a sub-casing 40 arranged between the upper housing 23 and the lower housing 37. The upper housing 23 has a suction nozzle 23A as a suction part formed at its top, and the sub-casing 40 has a discharge nozzle 23B as a discharge part formed on its side face. The upper housing 23 houses the discharge part 50, and the discharge-part-side part 21A on the discharge part 50 side of the rotating shaft 21. The suction nozzle 23A has a suction opening 55A formed therein, and the discharge nozzle 23B has a discharge opening 55B formed therein. The suction nozzle 23A sucks gas as a fluid (for example, corrosive process gas, or gas containing reaction products) downward in the vertical direction from the suction opening 55A. The discharge nozzle 23B discharges the sucked gas downward in the vertical direction from the discharge opening 55B.

The discharge part 50 includes a plurality of (nine) stages of stationary impellers 71, 28, a plurality of (five) stages of first turbine impellers 70 as rotating impellers, a plurality of (two) stages of second turbine impellers 80 as rotating impellers, and a plurality of (three) stages of centrifugal impellers (centrifugal drag impellers) 24 as rotating impellers. The first turbine impellers 70 have first (top) to fifth stages, forming a turbine impeller part 73. The second turbine impellers 80, and the centrifugal impellers 24 are mounted on the rotating shaft 21. The stationary impellers 71 have seven stages, and are arranged immediately downstream of the first turbine impellers 70 and the second turbine impellers 80. The stationary impellers 28 have two stages, and are arranged immediately downstream of the first and second stages of the centrifugal impellers 24. A centrifugal partition 43 as a partition is arranged downstream of the second turbine impeller 80 of the last stage and upstream of the centrifugal impeller 24 of the first stage (the eighth-stage rotating impeller). Gas exiting the second turbine impeller 80 of the second stage (the seventh stage as the last-stage turbine impeller) passes through an opening 43A of the centrifugal partition 43 to be sucked in from the opening 43A to the centrifugal impeller 24 of the first stage. The discharge part 50 exhibits both a discharge effect for discharge in the direction outward of the impellers due to the centrifugal force exerted on gas by the centrifugal impellers 24, and a drag effect due to the viscosity of gas between the individual stationary impellers 28, and thus discharges gas.

The stationary impeller 71 arranged immediately downstream of the last-stage second turbine impeller 80 has on the discharge side a discharge-side surface 79 formed as a flat surface, and the centrifugal partition 43 has on the suction side a discharge-side surface 97 formed as a flat surface. A substantially hollow cylindrical space (channel loss mitigation space 69) is formed between the discharge-side surface 79 and the discharge-side surface 97. The outer diameter of this space is substantially equal to the outer diameter of the last-stage second turbine impeller 80.

The first-stage centrifugal impeller 24 is arranged at an axial distance Lx from the last-stage second turbine impeller 80, and the channel loss mitigation space 69 is formed between the centrifugal impeller 24 and the second turbine impeller 80. The space 69 is formed for the purpose of mitigating loss at the time of the transition of a fluid flow from the axial direction to the radial direction. The axial distance Lx is provided between the discharge-side surface 79 of the stationary impeller 71 arranged immediately downstream of the last-stage second turbine impeller 80 (also the last-stage turbine impeller) and a front end face 26A (FIG. 5B) on the suction side of the centrifugal impeller 24 of the first stage which will be described later. The above-mentioned channel loss mitigation space is not formed between the first turbine impeller 70 of the last stage (the fifth-stage turbine impeller) and the second turbine impeller 80 of the first stage (the sixth-stage turbine impeller).

As described above, the discharge part 50 includes the turbine impeller part 73 having the first turbine impellers 70 in five stages. A hollow part 12 is formed in a boss part 74 of the turbine impeller part 73, and a through hole 58 is formed at a bottom part 12B of the hollow part 12. The inner diameter of the hollow part 12 is formed larger than the inner diameter of the through hole 58. The inner diameter of the through hole 58 is formed smaller than the outer diameter of the rotating shaft 21. In an end face (end face on the side opposite the suction side) 11B in the lower portion of the turbine impeller part 73, there is formed a stepped part 14 that projects from the lower end face 11B. The through hole 58 extends through the stepped part 14 as well.

A recess 13 is formed in a suction-part-side end face 15 in the upper portion of the rotating shaft 21, and a screw hole 16 is formed at the bottom of the recess 13. The turbine impeller part 73 is mounted to the suction-part-side end face 15, being fixed with a hexagonal bolt 78 serving as a screw member. The stepped part 14 of the turbine impeller part 73 engages with the recess 13 of the rotating shaft 21. This structure in which the stepped part 14 engages with the recess 13 allows the turbine impeller part 73 to be easily positioned concentrically with the rotating shaft 21. Thus, the turbine impeller part 73 can be mounted with its center axis aligned with the center axis of the rotating shaft 21, without being inclined with respect to a plane perpendicular to the center axis of the rotating shaft 21. Therefore, it is possible to prevent unbalance from changing during high-speed rotation, and achieve stability at the time of high-speed rotation. The hexagonal bolt 78 extends through the through hole 58 and is inserted in the screw hole 16. The inner diameter of the hollow part 12 is formed slightly larger than the outer diameter of the head of the hexagonal bolt 78, and set to a value suitable for the insertion and fastening of the hexagonal bolt 78.

The first-stage centrifugal impeller 24 is arranged at a position away from the suction-part-side end face 15 of the rotating shaft 21. Although one hexagonal bolt 78 is shown in the drawing, there may be provided a plurality of hexagonal bolts 78 arranged equidistant from the shaft center at equal intervals.

A round tubular ring 41 with a round tubular shape is mounted to the discharge-part-side part 21A of the rotating shaft 21 on the discharge part 50 side by shrink-fitting (interference-fitting). The suction-part-side end face of the round tubular ring 41 is flush with the suction-part-side end face 15 of the rotating shaft 21. A fitting hole 82 (FIG. 3) is formed at the center of the second turbine impellers 80, and a fitting hole 25 (FIG. 5) is formed at the center of the centrifugal impellers 24. The rotating shaft 21 to which the round tubular ring 41 is mounted by shrink-fitting extends through the fitting hole 82 and the fitting hole 25. The second turbine impellers 80 and the centrifugal impellers 24 are fixed to the rotating shaft 21 by fitting and stacked in layers. The round tubular ring 41 is arranged between the second turbine impellers 80 and the rotating shaft 21 and between the centrifugal impellers 24 and the rotating shaft 21, in the radial direction of the rotating shaft 21. The round tubular ring 41 covers a portion of the rotating shaft 21 where two stages of the second turbine impellers 80 and three stages of the centrifugal impellers 24 are mounted, and also covers a portion of the rotating shaft 21 extending, from a portion corresponding to the large diameter part 54 where the centrifugal impellers 24 are not mounted, to the suction-part-side end face 15, with respect to the axial direction of the rotating shaft 21. In a portion of the round tubular ring 41 corresponding to the channel loss mitigation space 69 between the last-stage second turbine impeller 80 and the first-stage centrifugal impeller 24, a shaft sleeve 42 is mounted on the radially outer side of the round tubular ring 41.

The round tubular ring 41 is shrink-fitted on the portion of the rotating shaft 21 through which the second turbine impellers 80 and the centrifugal impellers 24 extend to be fixed in place. Since the round tubular ring 41 is shrink-fitted on the rotating shaft 21, the rigidity of the entire rotary shaft including the round tubular ring 41 is enhanced. Thus, the rotary shaft can be extended to ensure a sufficient axial dimension (the axial length of the channel loss mitigation space 69) between the last-stage second turbine impeller 80 and the first-stage centrifugal impeller 24, thereby making it possible to enhance the discharge performance of the second turbine impellers 80.

Since the rotary shaft is divided into the round tubular ring 41 and the rotating shaft 21, it is also possible to form the round tubular ring 41 from a material with a high Young's modulus different from that of the rotating shaft 21.

The lower housing 37 houses the motion control part 51, and the motion-control-part-side part 21B on the motion control part 51 side of the rotating shaft 21. The motion control part 51 includes an upper protective bearing 35, an upper radial magnetic bearing 31, a motor 32 for rotatably driving the rotating shaft 21, a lower radial magnetic bearing 33, a lower protective bearing 36, and an axial magnetic bearing 34 that are arranged in this order from top to bottom in the vertical direction. The upper radial magnetic bearing 31 and the lower radial magnetic bearing 33 rotatably support the rotating shaft 21 at the motion-control-part-side part 21B of the rotating shaft 21. The axial magnetic bearing 34 bears a force due to the weight of a rotor which is exerted downward in the drawing, and a thrust force exerted upward and downward in the drawing. It should be noted that the discharge-part-side part 21A of the rotating shaft 21 forms an overhang portion of the rotating shaft 21. A thrust board 85 is mounted with a stud bolt 86 (partially shown in the drawing) to an end face 17 on the side opposite the suction part of the rotating shaft 21. The axial magnetic bearing 34 is arranged across the thrust panel 85, and bears the weight and the thrust force of the rotor exerted from the thrust board 85.

The magnetic bearings 31, 33 and 34 are all active magnetic bearings. When an abnormality occurs in any one of the magnetic bearings 31, 33 and 34, the upper protective bearing 35 supports the rotating shaft 21 in the radial direction of the rotating shaft 21 in place of the upper radial magnetic bearing 31, and the lower protective bearing 36 supports the rotating shaft 21 in the radial and axial directions of the rotating shaft 21 in place of the lower radial magnetic bearing 33 and the axial magnetic bearing 34.

Figure 2A:
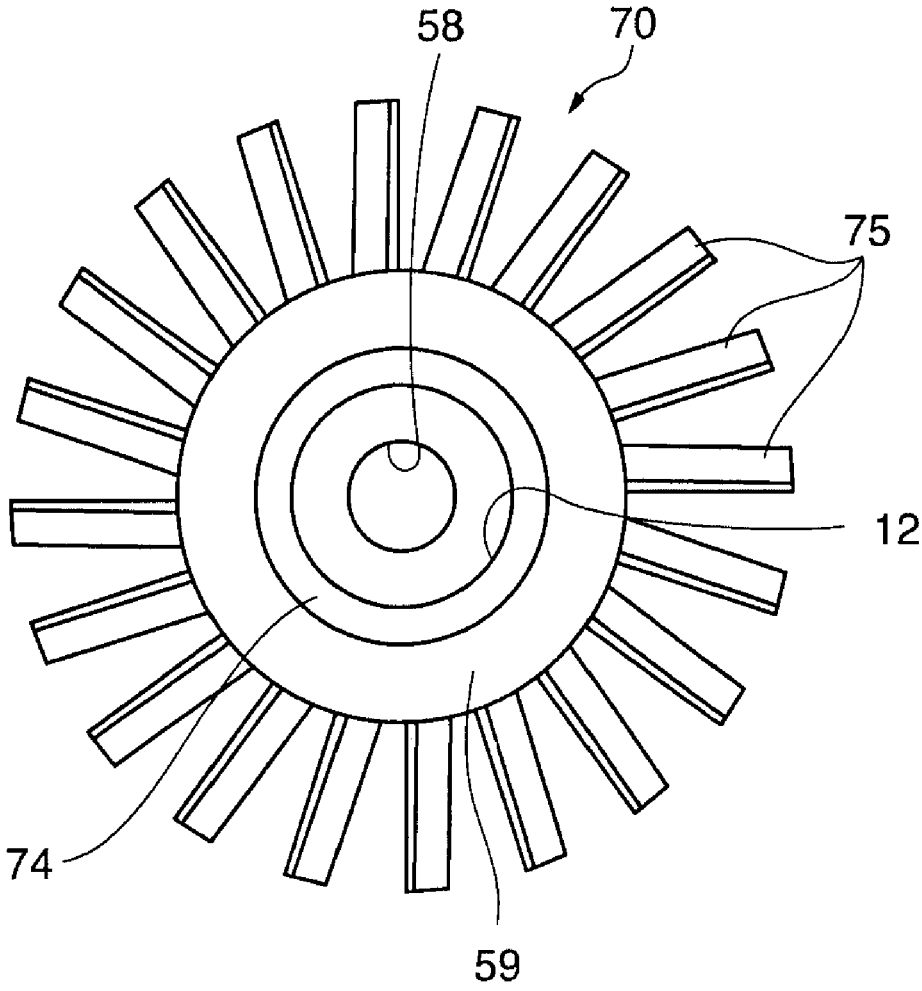
FIG. 2A is a plan view of a turbine impeller part of the turbo vacuum pump shown in FIG. 1.
Figure 2B:
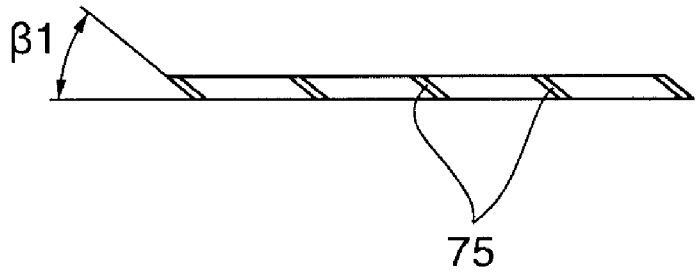
FIG. 2B is a plan view, partially developed on a plane, of a turbine impeller as seen radially toward the center.

Referring to FIGS. 2A and 2B, the configuration of the turbine impeller part 73 (FIG. 1) will be described. FIG. 2A is a plan view of the turbine impeller part 73 as seen from the suction nozzle 23A (FIG. 1) side. In the drawing, only the first turbine impeller 70 of the first stage of the turbine impeller part 73 is shown, and the hexagonal bolt 78 (FIG. 1) is omitted. FIG. 2B is a plan view, partially developed on a plane, of the first turbine impeller 70 of the first stage as seen radially toward the center.

The turbine impeller part 73 includes the boss part 74, the first turbine impellers 70 in five stages, and a mounting ring 59 located between the boss part 74 and the first turbine impellers 70. Each of the first turbine impellers 70 has a plurality of plate-like vanes 75 formed radially in the outer periphery of the mounting ring 59. The mounting ring 59 is formed integrally with the boss part 74. The hollow part 12 and the through hole 58 are formed in the boss part 74. Each vane 75 is formed at a twist angle of $\beta 1$ (for example, 10 to 40 degrees) with respect to the center axis of the rotating shaft 21. While the configuration of the second to fifth stages (not shown in FIGS. 2A and 2B) of the first turbine impellers 70 is the same as the configuration of the first turbine impeller 70 of the first stage, the number of the vanes 75, the mounting angle $\beta 1$ of the vanes 75, the outer diameter of the portion of the boss part 74 where the vanes 75 are formed, and the length of the vanes 75 may be changed as appropriate.

Figure 3A:
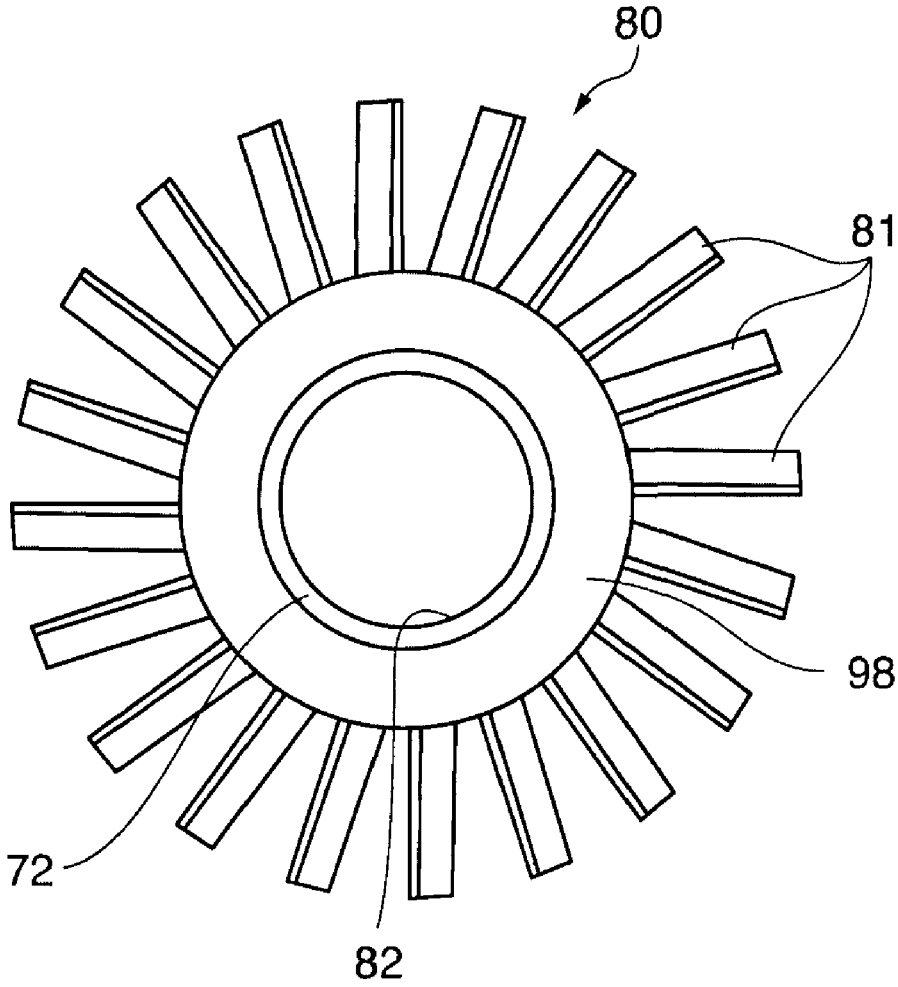
FIG. 3A is a plan view of a second turbine impeller of the turbo vacuum pump shown in FIG. 1.
Figure 3B:
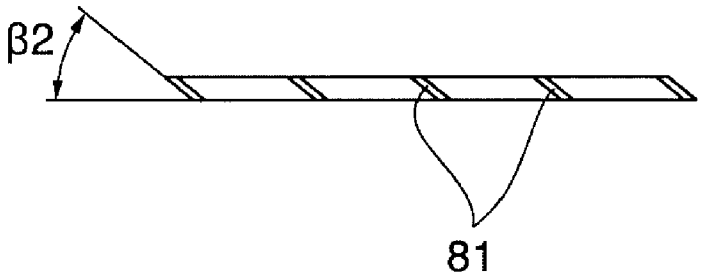
FIG. 3B is a plan view, partially developed on a plane, of the second turbine impeller as seen radially toward the center.

Referring to FIGS. 3A and 3B, the configuration of the second turbine impellers 80 (FIG. 1) will be described. FIG. 3A is a plan view of the second turbine impellers 80 as seen from the suction nozzle 23A (FIG. 1) side, and the hexagonal bolt 78 (FIG. 1) is omitted. FIG. 3B is a plan view, partially developed on a plane, of the second turbine impeller 80 of the first stage as seen radially toward the center.

Each of the second turbine impellers 80 includes a boss part 72, a plurality of plate-like vanes 81, and a mounting ring 98 located between the boss part 72 and the vanes 81. The vanes 81 are formed radially on the outer periphery of each mounting ring 98. The fitting hole 82 is formed in the boss part 72. Each vane 81 is formed at a twist angle of β2 (for example, 10 to 40 degrees) with respect to the center axis of the rotating shaft 21. While the configuration of the second turbine impeller 80 of the second stage is the same as the configuration of the second turbine impeller 80 of the first stage, the number of the vanes 81, the mounting angle β2 of the vanes 81, the outer diameter of the portion of the boss part 72 where the vanes 81 are formed, and the length of the vanes 81 may be changed as appropriate.

Figure 4A:
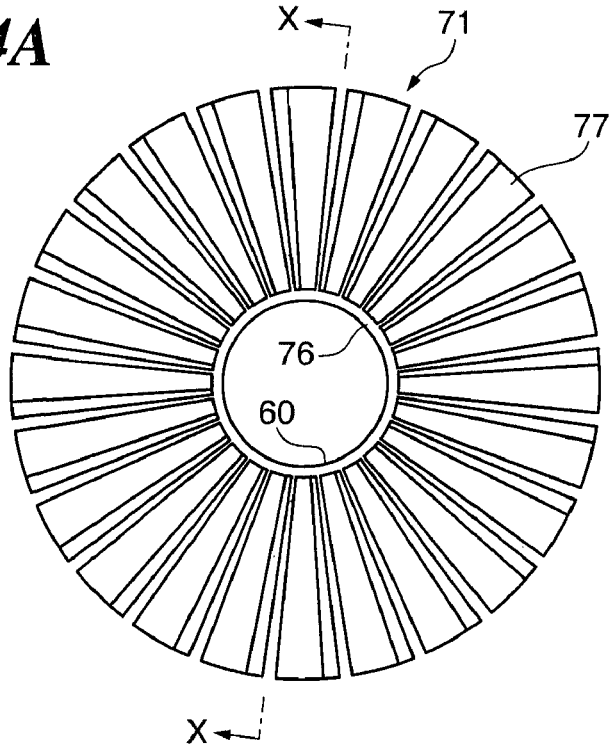
FIG. 4A is a plan view of a stationary impeller for each of a first turbine impeller and second turbine impeller of the turbo vacuum pump shown in FIG. 1.
Figure 4B:
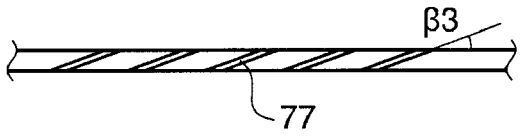
FIG. 4B is a front view of the same.
Figure 4C:
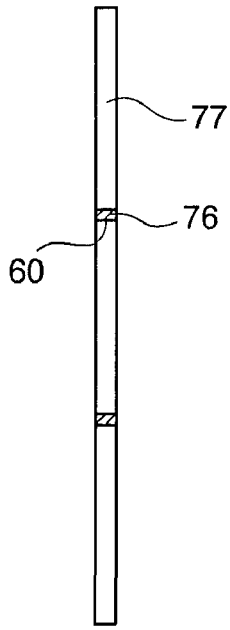
FIG. 4C is a cross sectional view taken along the line X-X of FIG. 4A.

Referring to FIGS. 4A, 4B and 4C, the configuration of the stationary impeller 71 of the first stage will be described. FIG. 4A is a plan view of the stationary impeller 71 of the first stage as seen from the suction nozzle 23A (FIG. 1) side. FIG. 4B is a plan view, partially developed on a plane, of the stationary impeller 71 of the first stage as seen radially toward the center. FIG. 4C is a cross sectional view taken along the line X-X of FIG. 4A.

The stationary impeller 71 includes an annular part 76 with an annular shape, and plate-like vanes 77 formed radially in the outer periphery of the annular part 76. The inner periphery of the annular part 76 defines a shaft hole 60, and the rotating shaft 21 (FIG. 1) extends through the shaft hole 60. Each vane 77 is formed at a twist angle of β3 (for example, 10 to 40 degrees) with respect to the center axis of the rotating shaft 21. While the configuration of the second to seventh stages of the stationary impellers 71 is the same as the configuration of the stationary impeller 71 of the first stage, the number of the vanes 77, the mounting angle β3 of the vanes 77, the outer diameter of the annular part 76, and the length of the vanes 77 may be changed as appropriate.

Figure 5A:
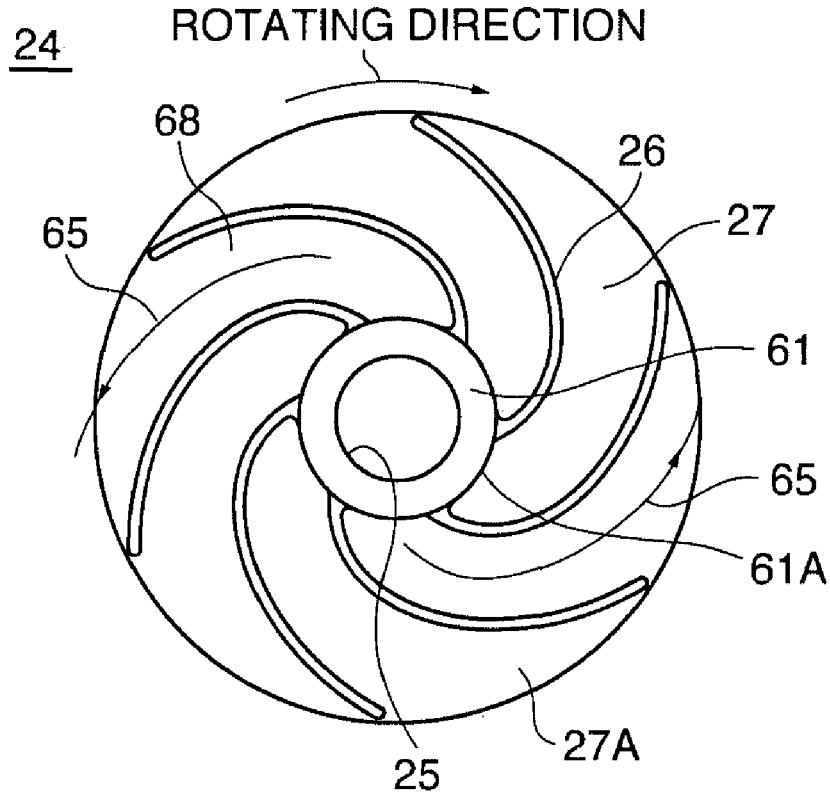
FIG. 5A is a plan view of a centrifugal impeller of the turbo vacuum pump shown in FIG. 1.
Figure 5B:
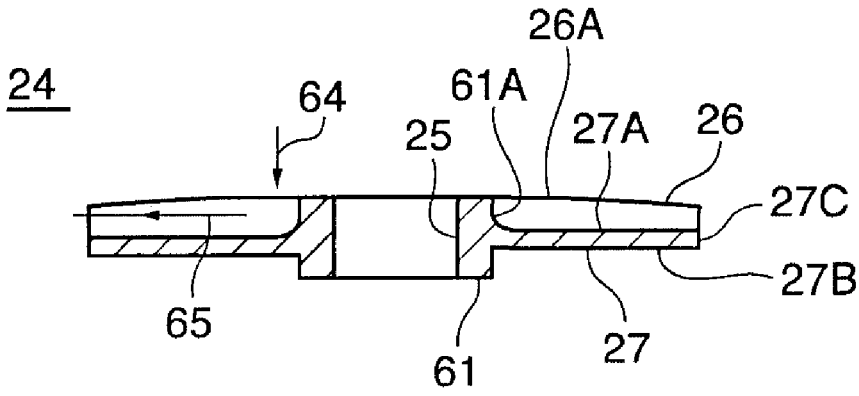
FIG. 5B is a front cross sectional view of the same.

Referring to FIGS. 5A and 5B, the configuration of the centrifugal impellers 24 (FIG. 1) will be described. FIG. 5A is a plan view of the centrifugal impeller 24 of the first stage as seen from the suction nozzle 23A (FIG. 1) side, and FIG. 5B is a front cross sectional view thereof. The centrifugal impeller 24 of the first stage includes a substantially disk-shaped base part 27 having a boss part 61, and spiral vanes 26 fixed on a front surface 27A on one side of the base part 27. The rotating direction of the centrifugal impellers 24 is clockwise in FIG. 5A.

The spiral vanes 26 are made up of a plurality of (six) vanes having a spiral shape as shown in FIG. 5A. The spiral vanes 26 extend along a gas flow direction so as to be oriented rearward with respect to the rotation direction (in a direction opposite to the rotation direction). Each of the spiral vanes 26 having a front end face 26A on the suction side extends from an outer peripheral surface 61A of the boss part 61 to an outer peripheral part 27C of the base part 27. The other surface located on the side opposite the front surface 27A is a back surface 27B. The front surface 27A and the back surface 27B are, for example, perpendicular to the center axis of the rotating shaft 21 (FIG. 1). The above-described fitting hole 25 is formed in the boss part 61. While the configuration of the second and third stages (not shown in FIGS. 5A and 5B) of the centrifugal impellers 24 is the same as the configuration of the centrifugal impeller 24 of the first stage, the number and the shape of the vanes 26, the outer diameter of the boss part 61, and the length of a channel defined by the spiral vanes 26 may be changed as appropriate. It should be noted that in the back surface 27B of the centrifugal impellers 24, gas is compressed from the outer peripheral side to the inner peripheral side of the centrifugal impellers 24 solely by the effect of gas viscosity.

Figure 6A:
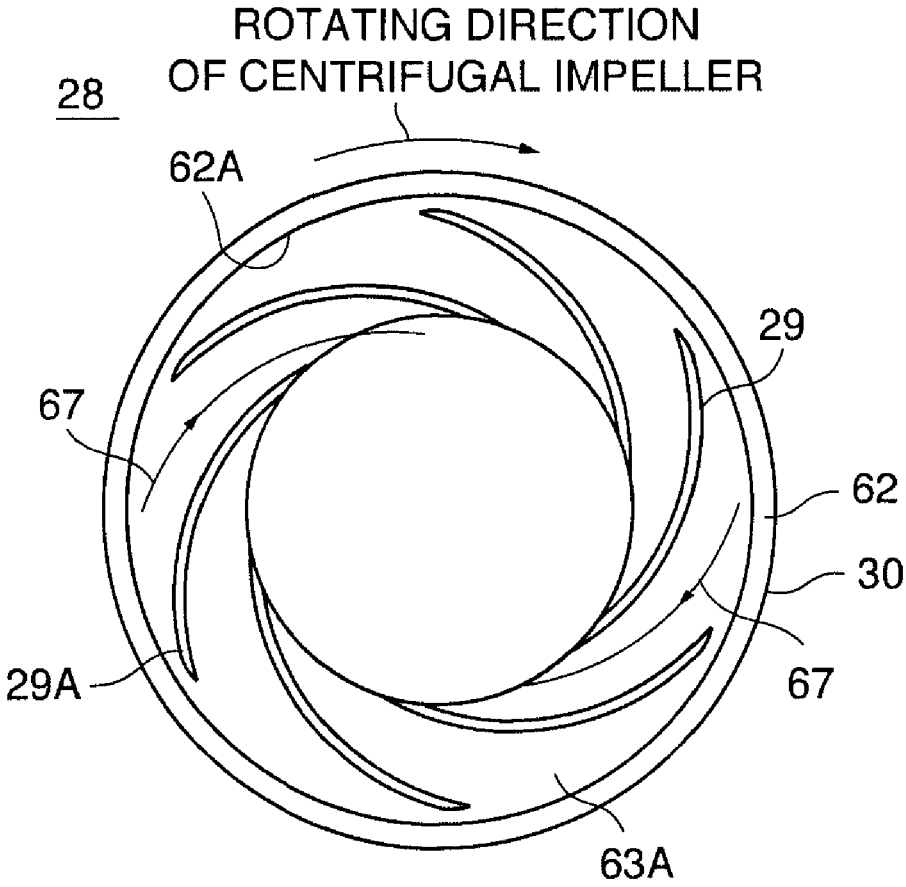
FIG. 6A is a plan view of a stationary impeller for a centrifugal impeller of the turbo vacuum pump shown in FIG. 1.
Figure 6B:
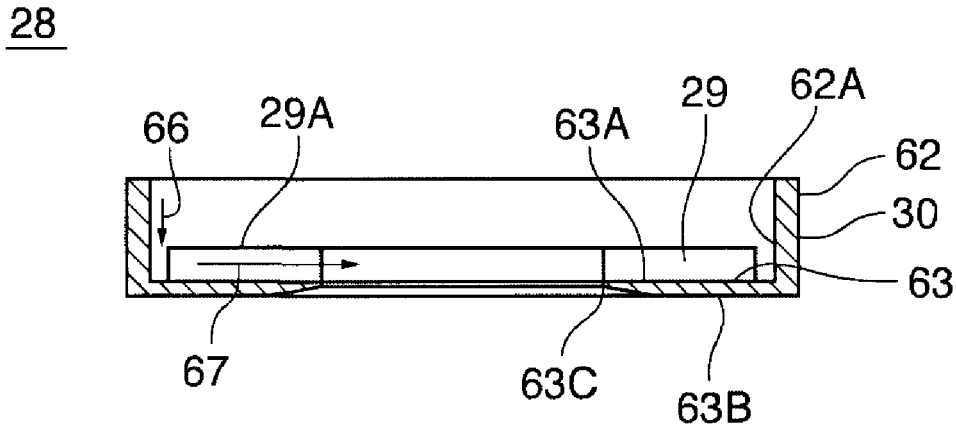
FIG. 6B is a front cross sectional view of the same.

Referring to FIGS. 6A and 6B, the configuration of the stationary impeller 28 of the first stage will be described. FIG. 6A is a plan view of the stationary impeller 28 as seen from the suction nozzle 23A (FIG. 1) side. FIG. 6B is a front cross sectional view thereof. The stationary impeller 28 has a stationary impeller body 30 having an outer peripheral wall 62 and a side wall 63, and spiral guides 29 that protrude from a front surface 63A on one side of the side wall 63 and have a raised cross-section. The rotating direction of the centrifugal impellers 24 (FIG. 1) is clockwise in FIG. 6A.

The spiral guides 29 are made up of a plurality of (six) guides 29 having a spiral shape as shown in FIG. 6A. The spiral guides 29 extend forward in a gas flow direction forward with respect to the rotation direction (in the same direction as the rotation direction). Each of the spiral guides 29 extends from an inner peripheral part 62A of the outer peripheral wall 62 to an inner peripheral part 63C of the side wall 63 of the stationary impeller 28. An end face 29A of the spiral guides 29, which is located on a plane perpendicular to the center axis of the rotating shaft 21, is a smooth surface. A back surface 63B of the side wall 63 located on the side opposite the spiral guides 29 has a flat, smooth surface. Therefore, the back surface 63B of the stationary impellers 28 directly facing the spiral vanes 26 of the centrifugal impellers 24 (FIG. 5) does not disturb the flow of gas flowing through a channel extending along a direction 65 (FIG. 5A) and formed between the spiral vanes 26 of the centrifugal impellers 24. While the configuration of the stationary impeller 28 of the second stage (not shown in FIGS. 6A and 6B) is the same as the configuration of the stationary impeller 28 of the first stage, the number and the shape of the spiral guides 29 may be changed as appropriate.

While it has been described that the turbine impeller part 73 is fixedly mounted to the suction-part-side end face 15 with the hexagonal bolt 78, the hexagonal bolt 78 may be another kind of bolt, for example, a bolt with a hexagonal hole.

Next, the operation of the turbo vacuum pump 1 will be described with reference to FIGS. 1 to 6 as appropriate.

As the first turbine impeller 70 of the first stage rotates, gas is introduced in the axial direction in FIG. 1 through the suction nozzle 23A of the pump 1. The use of the first turbine impeller 70 makes it possible to increase the discharge rate (velocity), allowing a relatively large amount of gas to be discharged. The introduced gas is reduced in speed and raised in pressure by the stationary impeller 71. Likewise, the gas is discharged in the axial direction and raised in pressure, by the second to fifth stages of the first turbine impellers 70, by the second to fifth stages of stationary impellers 71, and further by the first and second stages of the second turbine impellers 80, by the sixth and seventh stages of stationary impeller 71.

Then, since the centrifugal impeller 24 of the first stage is rotating, gas is introduced in the axial direction. The gas introduced to the centrifugal impeller 24 of the first stage undergoes such compression and discharge that the gas is directed toward the outer diameter side of the centrifugal impeller 24 of the first stage along the front surface 27A of the base part 27 of the centrifugal impeller 24 of the first stage, by the interaction of the centrifugal impeller 24 of the first stage and the stationary impeller 28 of the first stage, that is, by a drag effect due to the viscosity of the gas, and further by a centrifugal effect caused by the rotation of the centrifugal impellers 24.

That is, the gas introduced to the centrifugal impeller 24 of the first stage is introduced in a substantially axial direction 64 in FIG. 5B with respect to the centrifugal impeller 24, flows toward the outer diameter side through a channel 68 defined between the spiral vanes 26 of the centrifugal impeller 24 of the first stage, and is compressed and discharged. This gas flow direction is the direction 65 shown in FIGS. 5A and 5(*b*). This direction is the direction of gas flow with respect to the centrifugal impeller 24 of the first stage.

The gas compressed toward the outer diameter side by the centrifugal impeller 24 of the first stage then flows to the stationary impeller 28 of the first stage, has its direction changed to a substantially axial direction 66 in FIG. 6B by the inner peripheral part 62A of the outer peripheral wall 62, and flows into a space where the spiral guides 29 are provided. As the centrifugal impeller 24 of the first stage rotates, the gas undergoes such compression and discharge that the gas is directed toward the inner diameter side of the stationary impeller 28 of the first stage along the front surface 63A of the side wall 63 (the side of the side wall 63 where the spiral guides 29 are formed) of the stationary impeller 28 of the first stage, by a drag effect caused by the viscosity of the gas between the end face 29A of the spiral guides 29 of the stationary impellers 28 and the back surface 27B of the base part 27 of the centrifugal impeller 24 of the first stage. The gas having reached the inner diameter side of the stationary impeller 28 of the first stage has its direction changed to the substantially axial direction 64 in FIG. 5B by the outer peripheral surface 61A of the boss part 61 of the centrifugal impeller 24 of the first stage, and is introduced to the centrifugal impeller 24 of the second stage. The gas undergoes similar compression and discharge, and is discharged from the discharge nozzle 23B via the centrifugal impeller 24 of the third stage.

Generally, in the case of the rotating shaft 21 alone, if the outer diameter of the rotating shaft 21 is fixed, the natural frequency Fs can be made higher as the length of the rotating shaft 21 is made shorter. However, since the rotating impellers 70, 80, 24 are mounted to the rotating shaft 21, the natural frequency Fa of the rotor as a whole is determined by a rate by which the natural frequency Fs of the rotating shaft 21 alone decreases due to the mass and moment of inertia of the rotating impellers 70, 80, 24 mounted to the rotating shaft 21. In this regard, to effectively increase the natural frequency Fa of the rotor as a whole, generally, it is necessary to suppress the rate by which the natural frequency Fa decreases due to the mounting of the rotating impellers 70, 80, 24, while making the natural frequency Fs of the rotating shaft 21 alone higher (for example, while making its axial length shorter).

Figure 7:
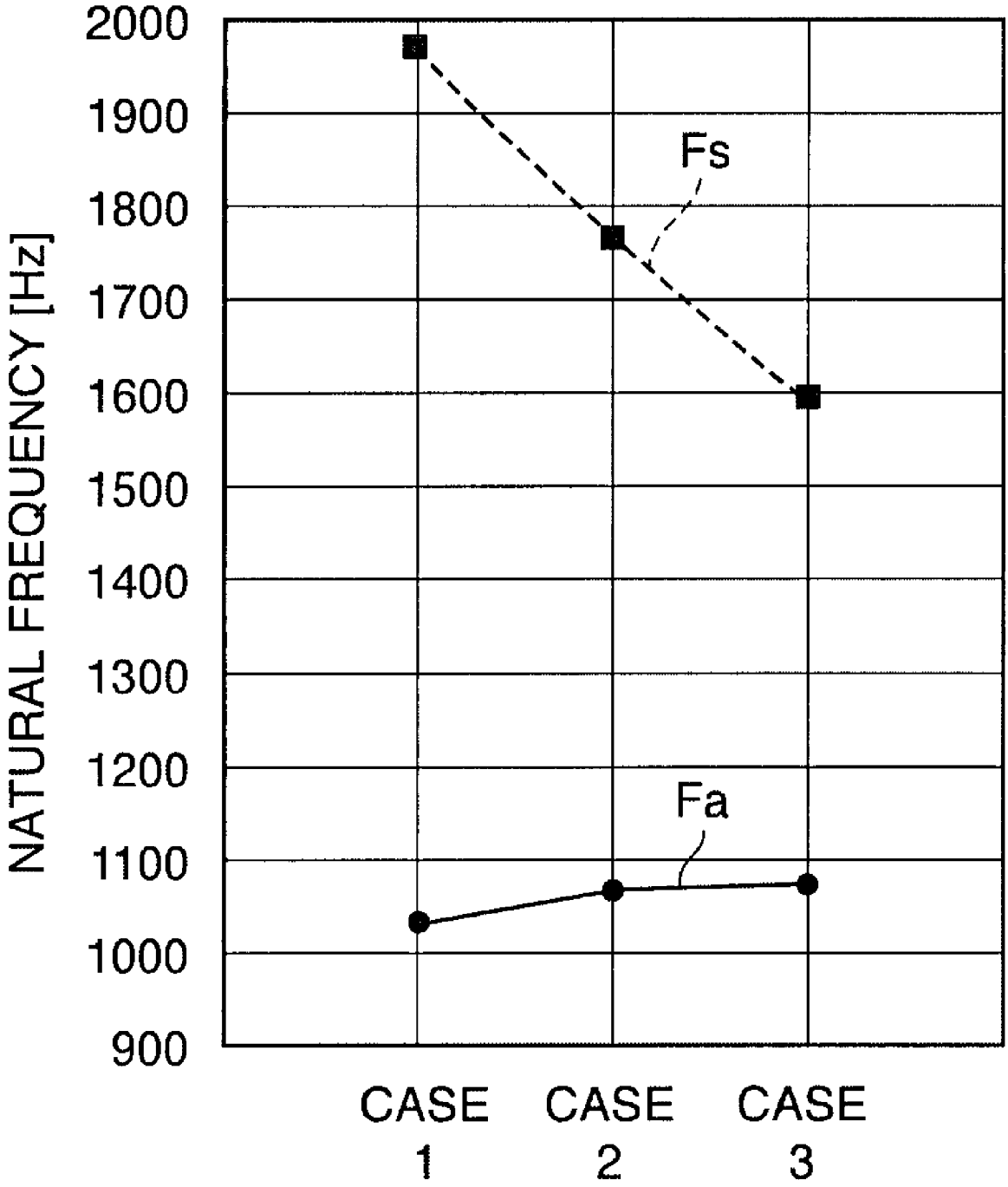
FIG. 7 is a graph showing how the natural frequency Fs of a rotating shaft and the natural frequency Fa of a rotor change in Cases 1 to 3 in which the arrangement of turbine impellers is varied.

Under the following assumptions: the axial diameter of the rotating shaft is fixed; the length (L) from one shaft end on the discharge part side of the rotating shaft to the end on the suction part side of the turbine impeller part mounted at the other shaft end on the suction part side is fixed; and the total number of stages, including turbine impellers mounted at the shaft end and turbine impellers arranged in a line on the shaft continuously to these turbine impellers (without a channel loss mitigation space arranged between the turbine impellers at the shaft end and the turbine impellers on the shaft), is fixed to seven; FIG. 7 is a graph showing how the respective (primary) natural frequencies Fs, Fa of the rotating shaft and the rotor change, in a case when all the seven stages are arranged at the shaft end, and cases when the number of turbine impeller stages arranged at the shaft end is reduced one by one by moving the turbine impeller stages one by one onto the shaft.

In FIG. 7, Case 1 represents a case in which seven stages of turbine impellers are all mounted at the shaft end, Case 2 represents a case in which six stages of turbine impellers are mounted at the shaft end and one stage of turbine impeller is mounted on the shaft, and Case 3 represents a case in which five stages of turbine impellers are mounted at the shaft end and two stages of turbine impellers are mounted on the shaft. In the drawing, the vertical axis represents the natural frequencies Fs and Fa (unit: Hz), and the horizontal axis represents the case number. In the drawing, as compared with the case (Case 1) in which all of the seven stages are arranged at the shaft end, when the arrangement of turbine impellers is changed to that having one stage on the shaft/six stages at the shaft end (Case 2), and that having two stages on the shaft/five stages at the shaft end (Case 3), the natural frequency Fs of the rotating shaft progressively decreases, while the natural frequency Fa of the rotor progressively increases. It should be noted that Case 3 corresponds to the configuration of the turbo vacuum pump 1 in FIG. 1.

FIG. 8 shows, in the form of a table, the natural frequency Fs of the rotating shaft and the natural frequency Fa of the rotor in each of Cases 1 to 3.

Figure 9:
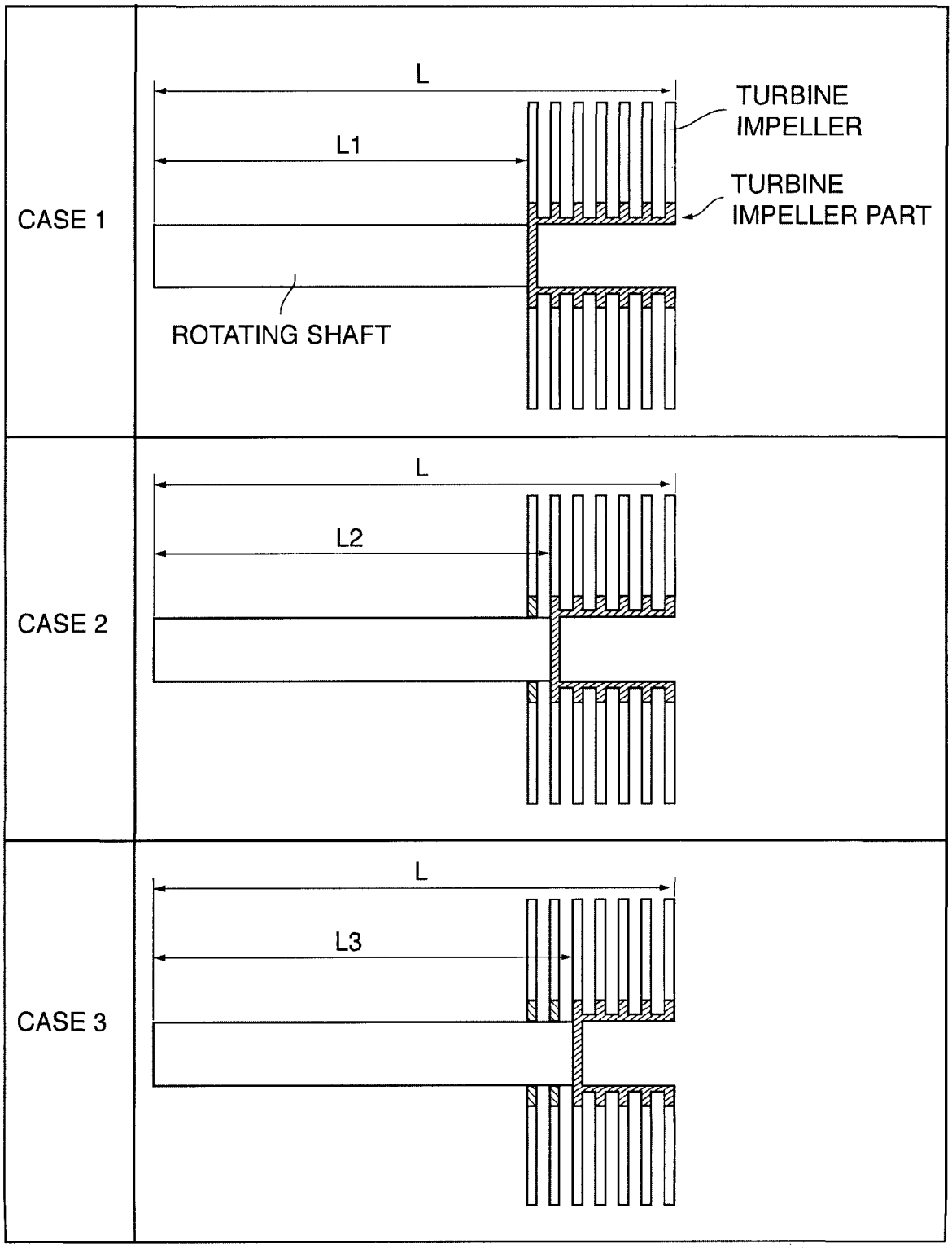
FIG. 9 is a diagram showing a modeled representation of turbine impeller arrangements in Cases 1 to 3.

FIG. 9 shows a modeled representation of turbine impeller arrangements in Cases 1 to 3. While the centrifugal impellers are to be taken into account in the calculation of the natural frequency Fa of the rotor, the centrifugal impellers are omitted in the drawing. Defining the length of the rotating shaft from one shaft end on the discharge part side to the other end on the suction part side as L1 in Case 1, L2 in Case 2, and L3 in Case 3, the relationship L1<L2<L3 holds. The reason why the natural frequency Fa of the rotor becomes higher despite the fact that the length of the rotating shaft becomes longer is that since the number of stages of turbine impellers of the turbine impeller part fixed at the shaft end decreases, the weight of the turbine impeller part decreases, with the result that the effect of increasing natural frequency Fa due to the decrease in the weight of the turbine impeller part exceeds the effect of reducing natural frequency Fa due to the increased length of the rotating shaft.

By reducing the number of stages of the first turbine impellers of the turbine impeller part mounted at the shaft end of the rotating shaft, the position of the center of gravity of the turbine impeller part becomes closer to the shaft end of the rotating shaft, that is, the surface to which the turbine impeller part is mounted. Thus, the moment of inertia of the turbine impeller part about the shaft end (that is, about the shaft end orthogonal to the center axis of the rotating shaft) becomes smaller, which acts to increase the natural frequency Fa of the rotor.

In this embodiment, the first turbine impellers 70 and the second turbine impellers 80 which exhibit high discharge efficiency on the low pressure side, and the centrifugal impellers 24 that exhibit high discharge efficiency on the high pressure side are combined as described above to construct the turbo vacuum pump 1. Thus, the discharge efficiency of the pump can be increased as a whole. Also, since the centrifugal impellers 24 discharge gas radially, the channel length can be increased without increasing the axial length. Accordingly, since the length of the portion of the rotating shaft to which the second turbine impellers 80 and the centrifugal impellers 24 are mounted can be made shorter, the natural frequency Fa of the rotor as a whole increases, thus facilitating high-speed rotation.

In the turbo vacuum pump 1 according to this embodiment, seven stages of turbine impellers are divided to five stages of the first turbine impellers 70 and two stages of the second turbine impellers 80, and the five stages of the first turbine impellers 70 are fixed to the shaft end of the rotating shaft 21. Thus, the natural frequency Fa of the rotor can be increased as compared with a case where seven stages of turbine impellers are fixed at the shaft end of the rotating shaft 21, thus facilitating high-speed rotation.

Figure 10:
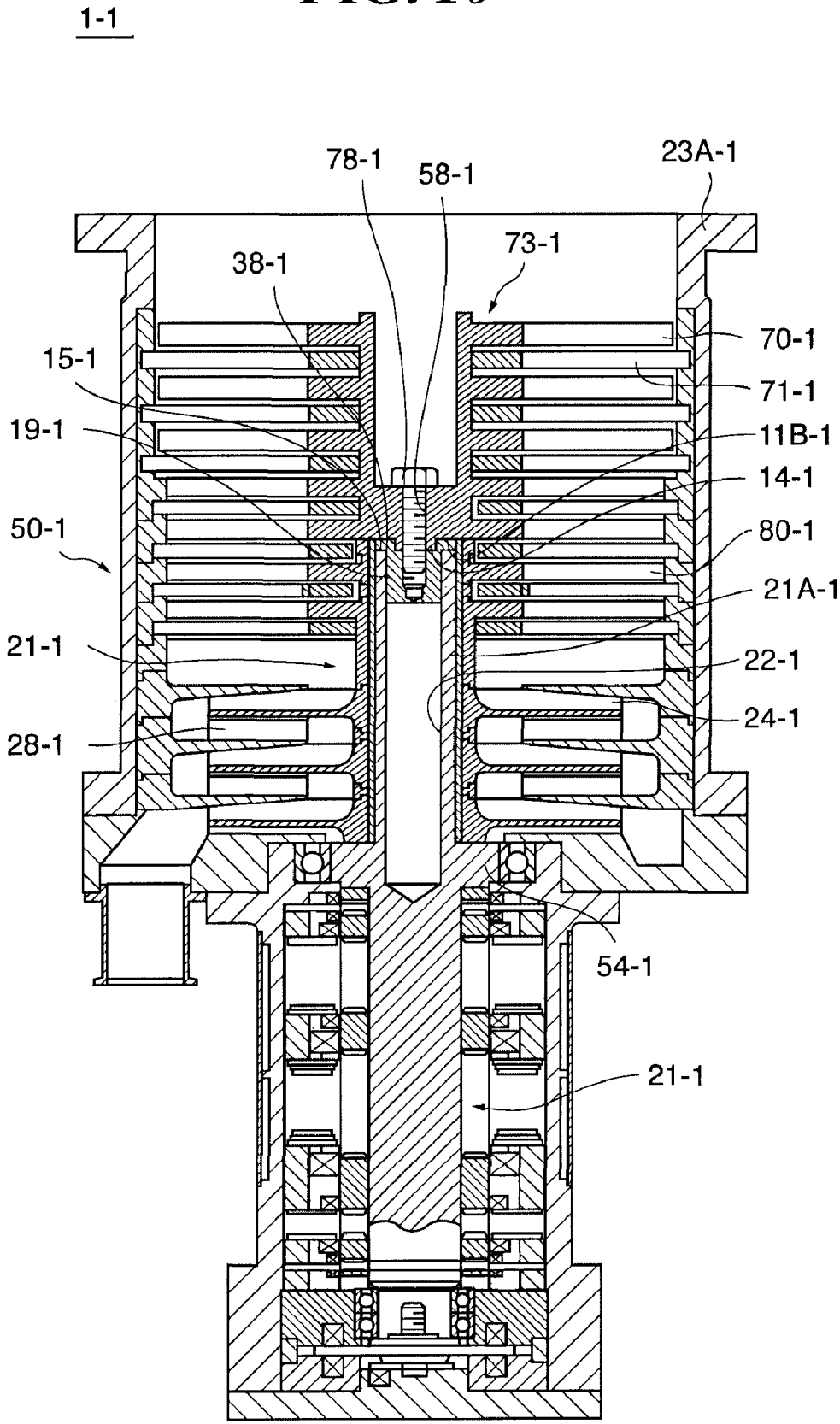
FIG. 10 is a front cross sectional view of a turbo vacuum pump according to a second embodiment of the present invention.

FIG. 10 is a front cross sectional view showing the configuration of a turbo vacuum pump 1-1 according to a second embodiment of the present invention. The turbo vacuum pump 1-1 differs from the turbo vacuum pump (FIG. 1) according to the first embodiment described above in that a hollow part 22-1 is formed in a rotating shaft 21-1, a boss 19-1 is inserted into the hollow part 22-1, a turbine impeller part 73-1 is mounted to an end face 15-1 of the rotating shaft 21-1 via the boss 19-1, and that a recess 13-1 (FIG. 11) is formed not in the rotating shaft but in the boss 19-1. Otherwise, the turbo vacuum pump 1-1 is of the same structure as the turbo vacuum pump 1 (FIG. 1) described above. The components of the turbo vacuum pump 1 (FIG. 1) correspond to those components of the turbo vacuum pump 1-1 described below which are denoted by the same numerals placed before the hyphens within the reference numbers. The hollow part 22-1 is formed in the suction-part-side end face 15-1 of the rotating shaft 21-1, and the rotating shaft 21-1 is of a hollow shaft structure.

In a discharge-part-side part 21A-1 on the discharge part 50-1 side of the rotating shaft 21-1, the hollow part 22-1 is formed in the axial direction of the rotating shaft 21-1. A space formed by the hollow part 22-1 has a circular column shape, and the center axis of the hollow part 22-1 is aligned with the center axis of the rotating shaft 21-1. The depth of the hollow part 22-1 reaches the portion of a large diameter part 54-1. In the hollow part 22-1, an opening 38-1 is formed at the suction-part-side end face 15-1 of the rotating shaft 21-1. A boss 19-1 for fixing the turbine impeller part 73-1 to the shaft end is inserted into the hollow part 22-1 from the opening 38-1 by shrink-fitting (interference-fitting). It should be noted that the hollow part is desirably formed in the entire overhang portion of the rotating shaft, or in a part of the overhang portion of the rotating shaft.

Figure 11:
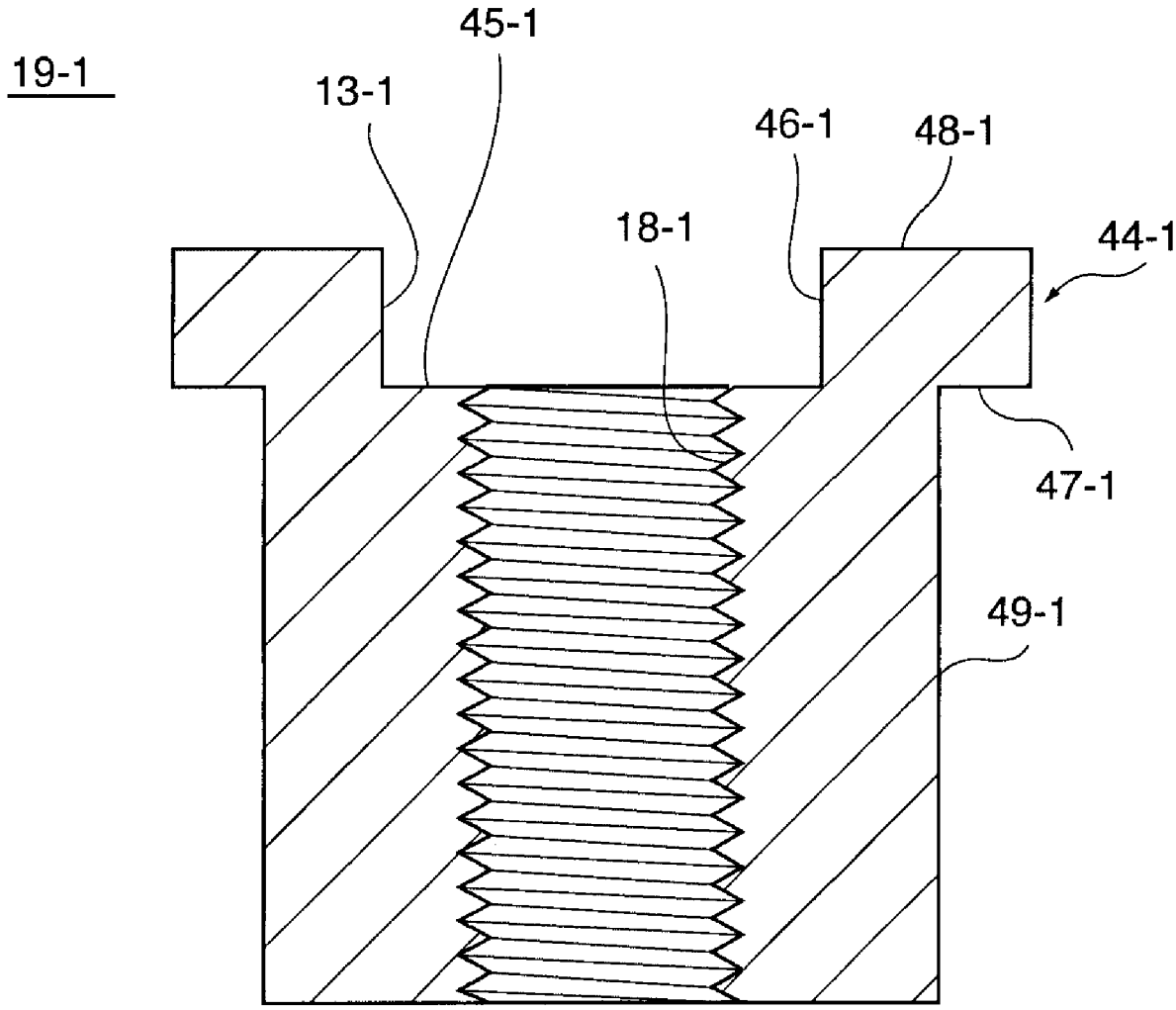
FIG. 11 is a front cross sectional view of a boss of the turbo vacuum pump shown in FIG. 10.

FIG. 11 is a cross sectional view of the boss 19-1. In the following, a description will be made with reference to FIGS. 10 and 11.

The boss 19-1 includes a cylindrical insertion part 49-1, and a ring-shaped flange part 44-1 formed above the insertion part 49-1. The insertion part 49-1 is inserted into the hollow part 22-1 of the rotating shaft 21-1. A screw hole 18-1 is formed in the insertion part 49-1. The center axis of the insertion part 49-1 is aligned with the center axis of the screw hole 18-1. An upper surface 45-1 of the insertion part 49-1 and an inner peripheral surface 46-1 of the flange part 44-1 form the recess 13-1. In a state with the boss 19-1 inserted in the hollow part 22-1, an end face 47-1 in the lower portion of the flange part 44-1 is in contact with the suction-part-side end face 15-1 in the upper portion of the rotating shaft 21-1. An end face 11B-1 (end face on the side opposite the suction-side part) in the lower portion of the turbine impeller part 73-1 is in contact with an upper surface 48-1 of the flange part 44-1. It should be noted that the suction-part-side end face of a round tubular ring 41-1 is flush with the upper surface 48-1 of the flange part 44-1 of the boss 19-1.

A stepped part 14-1 of the turbine impeller part 73-1 engages with the recess 13-1 of the boss 19-1, which allows the turbine impeller part 73-1 to be easily positioned concentrically with the rotating shaft 21-1. Thus, the turbine impeller part 73-1 can be mounted without being inclined, with its center axis aligned with the center axis of the rotating shaft 21-1. Therefore, it is possible to prevent unbalance from changing during high-speed rotation, and achieve stability at the time of high-speed rotation. A hexagonal bolt 78-1 extends through a through hole 58-1 of the turbine impeller part 73-1, and is inserted into the screw hole 18-1 of the boss 19-1, so the turbine impeller part 73-1 is mounted to the upper surface 48-1 of the flange part 44-1 of the boss 19-1. Thus, the turbine impeller part 73-1 is fixed to the end face 15-1 of the rotating shaft 21-1 via the boss 19-1.

When the overhang portion of a rotor having an overhang portion is formed as a hollow structure as in this embodiment, it is possible to reduce the weight of the rotor, and reduce the bearing load of the rotor having the overhang portion, with hardly any decrease in the natural frequency Fs of the rotating shaft 21 itself. Further, as compared with a rotor in which all of turbine impellers 70-1, 80-1 are arranged at the end face 15-1 of the rotating shaft 21-1 having the hollow part 22-1, assuming that the same turbine impellers 70-1, 80-1 are mounted, when a part of turbine impellers 70-1 are arranged at the shaft end of the rotating shaft 21-1 having the hollow part 22-1, and the remaining turbine impellers 80-1 are arranged on the rotating shaft 21-1 as in this embodiment, the natural frequency Fa of the rotor as a whole can be increased. As described above, to mount the turbine impeller part 73-1 with a part of the turbine impellers mounted thereto, to the end face 15-1 of the rotating shaft 21-1 in which the hollow part 22-1 is formed, the boss 19-1 is mounted to the shaft end of the hollow shaft structure by inserting into the hollow part 22-1. The boss 19-1 for fixing the turbine impeller part 73 needs to be secured to the rotating shaft 21-1, and the rotating shaft 21-1 and the boss may be fixed by shrink-fitting (interference-fitting), or may be fixed by welding. Provided that the boss to be inserted into the hollow part is fixed to the rotating shaft with a bolt, there is a need to form a bolt hole in a portion close to the outer peripheral surface of the rotating shaft. Since this reduces the strength of the portion where the bolt hole is formed, there is a need to increase the diameter of the rotating shaft. However, such a need can be obviated by fixing the boss by shrink-fitting or welding.

Since the hollow part 22-1 is provided in the rotating shaft 21-1, and the boss 19-1 is inserted into the hollow part 22-1, the second turbine impellers 80-1 can be mounted to the outer periphery of the portion of the rotating shaft 21-1 in which the boss 19-1 is inserted, thereby making the turbo vacuum pump 1-1 compact.

In this embodiment, an inside thread for fixing the turbine impeller part 73 is not provided in the inner periphery of the hollow part 22-1, and an outside thread is not provided in the outer periphery of the insertion part 49-1 of the boss 19-1. However, it is also possible to provide an inside thread for fixing the turbine impeller part 73 (for fixing, directly, the boss 19-1) in the inner periphery of the hollow part 22-1, and provide an outside thread in the outer periphery of the insertion part 49-1 of the boss 19-1, thus screwing the boss 19-1 into the hollow part 22-1 for fixation. In this case, the cutting of the thread in the hollow part 22-1 may require increasing the outer diameter of the rotating shaft 21-1.

Figure 13:
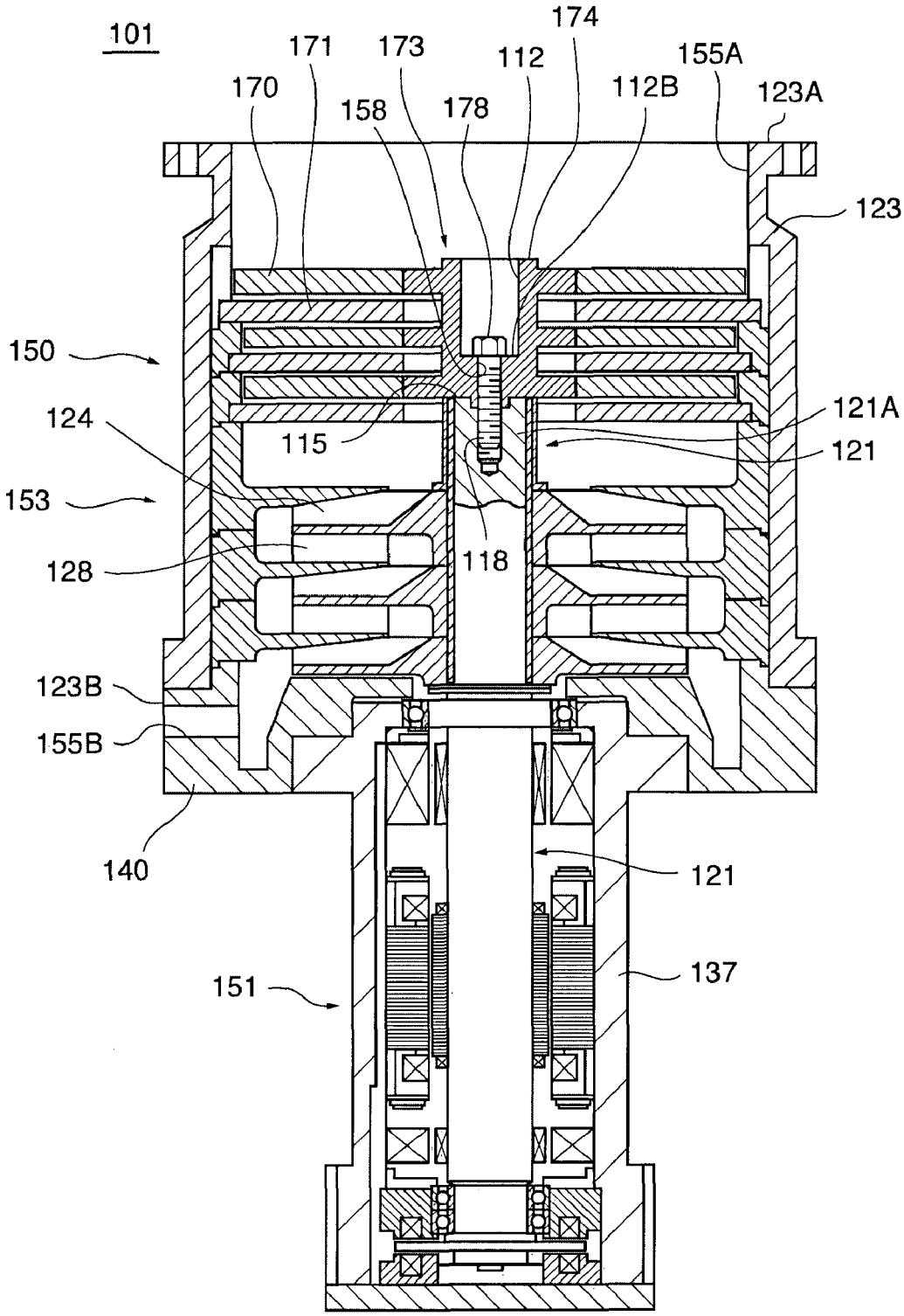
FIG. 13 PRIOR ART
FIG. 13 is a front cross sectional view of a turbo vacuum pump according to the prior art.

In this embodiment, it has been described that the total number of stages of turbine impellers is seven, and the first turbine impellers of the turbine impeller part, that is, the first turbine impellers mounted at the shaft end are formed in five stages. However, the stages of the first turbine impellers of the turbine impeller part may be made first to fourth, first to sixth, or first to seventh, and the second turbine impellers as the remainder may be mounted on the rotating shaft, without changing the total number of stages (seven stages). It should be noted that in the case of the prior art shown in FIG. 13 in which the first turbine impellers 170 of the turbine impeller part 173 are disposed in three stages, there are no second turbine impellers to be mounted on the rotating shaft 121.

In this embodiment, it has been described that the boss 19-1 has the recess 13-1 (FIG. 11), and the stepped part 14-1 of a raised shape formed in the turbine impeller part 73-1 is inserted into the recess 13-1 (FIG. 10). However, it is also possible to form a recess in the turbine impeller part 73-1, and form a raised stepped part in the boss 19-1, so that the raised stepped part of the boss 19-1 is inserted into the recess of the turbine impeller part 73-1 (not shown).

While it has been described (FIG. 10) that the boss 19-1 has the insertion part 49-1 (FIG. 11), and the insertion part 49-1 is inserted into the hollow part 22-1 of the rotating shaft 21-1, it is also possible to form a hollow part in the boss, and insert the distal end of the rotating shaft 21-1 into the hollow part of the boss, so that the boss serves as an externally mounted cover that closes the hollow part 22-1 of the rotating shaft 21-1 (not shown).

Figure 12:
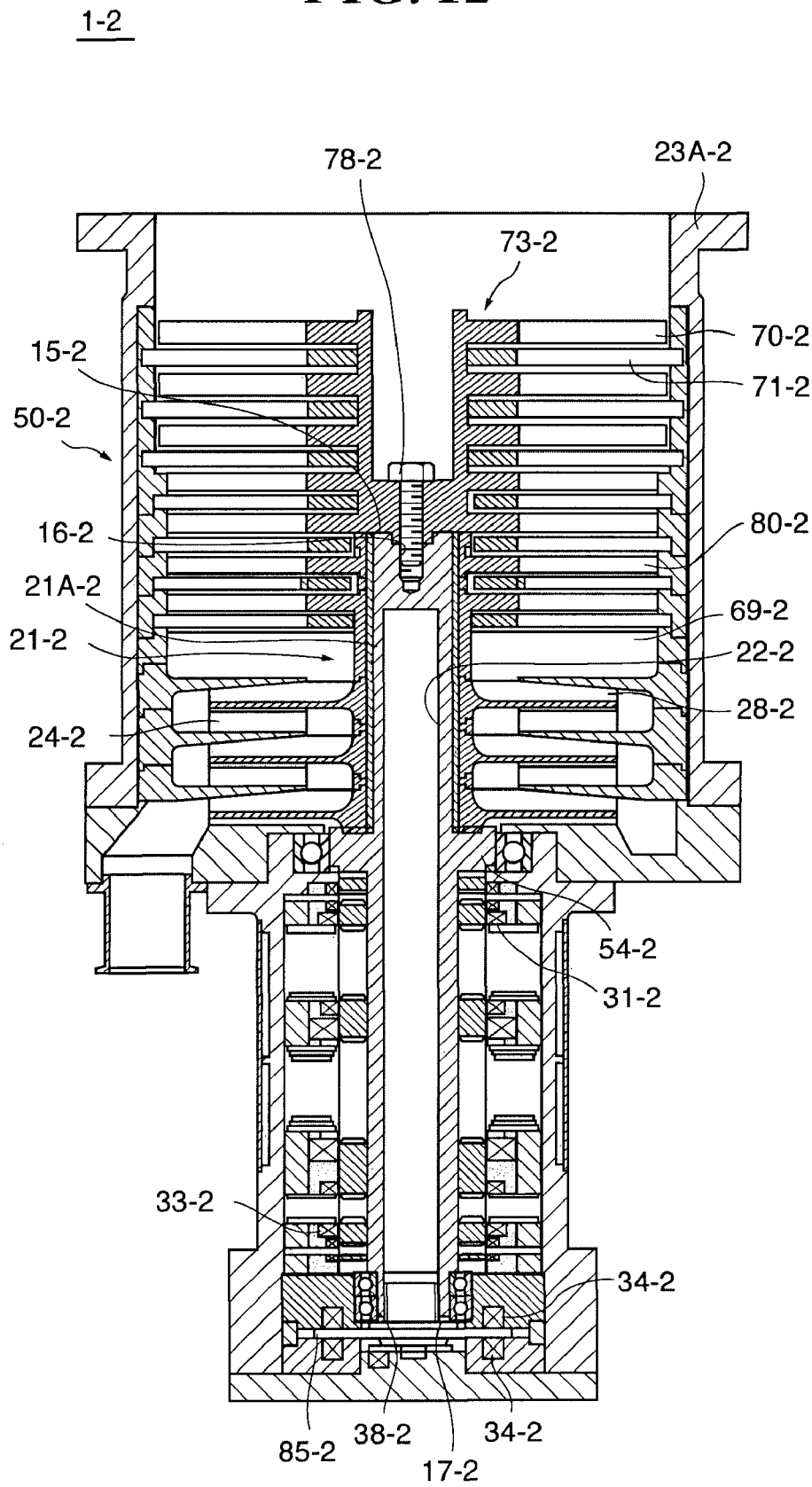
FIG. 12 is a front cross sectional view of a turbo vacuum pump according to a third embodiment of the present invention.

FIG. 12 is a front cross sectional view showing the configuration of a turbo vacuum pump 1-2 according to a third embodiment of the present invention. The turbo vacuum pump 1-2 differs from the turbo vacuum pump 1 (FIG. 1) according to the first embodiment described above in that a hollow part 22-2 is formed in a rotating shaft 21-2, and that a thrust board 85-2 is mounted by screwing into the hollow part 22-2. Otherwise, the turbo vacuum pump 1-2 is of the same structure as the turbo vacuum pump 1 (FIG. 1) described above. The components of the turbo vacuum pump 1 (FIG. 1) correspond to those components of the turbo vacuum pump 1-2 described below which are denoted by the same numerals placed before the hyphens within the reference numbers. The hollow part 22-2 is formed in an end face 17-2 on the side opposite the suction part of the rotating shaft 21-2, and the rotating shaft 21-2 is of a hollow shaft structure.

The hollow part 22-2 is formed in the axial direction in a discharge-part-side part 21A-2, that is a portion of the rotating shaft 21-2 on the discharge part 50-2 side. An opening 38-2 of the hollow part 22-2 is formed at a shaft end 17-2 on the side opposite the suction part of the rotating shaft 21-2. A space formed by the hollow part 22-2 has a circular column shape, and the center axis of the hollow part 22-2 is aligned with the center axis of the rotating shaft 21-2. In the drawing, the depth of the hollow part 22-2 reaches a position near a screw hole 16-2 formed in the rotating shaft 21-2. Therefore, in other words, the hollow part 22-2 does not reach the portion of the rotating shaft 21-2 where the screw hole 16-2 is formed. Also, the hollow part 22-2 does not extend through a suction-part-side end face 15-2. Thus, a turbine impeller part 73-2 can be easily and reliably mounted to the suction-part-side end face 15-2 of the rotating shaft 21-2 with a hexagonal bolt 78-2.

While the hollow part 22-2 does not extend through the suction-part-side end face 15-2 in this embodiment, the hollow part 22-2 may be formed to extend through the suction-part-side end face 15-2. In this case, it is necessary to provide a sealing mechanism (not shown) in the vicinity of the screw hole 16-2 so that the suction-part-side end face 15-2 and the hollow part 22-2 are not in communication.

On the side of the hollow part 22-2 where the opening 38-2 is provided, the thrust board 85-2 is mounted to the rotating shaft 21-2 by screwing. Depending on the case, the depth of the hollow part 22-2 may or may not reach the portion of the rotating shaft 21-2 where the second turbine impellers 80 are provided. In this embodiment, the depth of the hollow part 22-2 reaches the portion of the rotating shaft 21-2 where a second turbine impeller 80-2 of the last stage (the seventh-stage rotating impeller) is provided. The hollow part 22-2 reaches the portion where a channel loss mitigation space 69-2 is provided, via the portion of the rotating shaft 21-2 between the end face 17-2 on the side opposite the suction part and a magnetic bearing 33-2 on the side opposite the rotating impellers, the portion between the magnetic bearing 33-2 on the side opposite the rotating impellers and a magnetic bearing 31-2 on the rotating impeller side, the portion where the magnetic bearing 31-2 on the rotating impeller side is provided, the portion of a large diameter part 54-2, and the portion where centrifugal impellers 28-2 are provided.

When the rotating shaft 21-2 of a rotor having an overhang portion is formed as a hollow structure as in this embodiment, it is possible to suppress a decrease in the natural frequency Fs of the rotating shaft 21-2 itself, and reduce the weight of the rotor, thereby reducing the bearing load of the rotor having the overhang portion.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

1, 1-1, 1-2 turbo vacuum pump
11B, 11B-1 end face
12 hollow part
13, 13-1 recess
14, 14-1 stepped part
15, 15-1, 15-2 suction-part-side end face
16, 16-2 screw hole
17, 17-2 end face
18-1 screw hole
19-1 boss
21, 21-1, 21-2 rotating shaft
21A, 21A-1, 21A-2 discharge-part-side part
21B motion-control-part-side part
22-1, 22-2 hollow part
23 upper housing
23A, 23A-1, 23A-2 suction nozzle (suction part)

23B discharge nozzle
24 centrifugal impellers (rotating impeller)
25 fitting hole
26 spiral vane
26A front end face
27 base part
27A front surface
27B back surface
27C outer peripheral part
28, 28-2 stationary impeller
29 spiral guide
29A end face
30 stationary impeller body
31, 31-2 upper radial magnetic bearing
32 motor
33, 33-2 lower radial magnetic bearing
34, 34-2 axial magnetic bearing
35 upper protective bearing
36 lower protective bearing
37 lower housing
38, 38-2 opening
40 sub-casing
41 round tubular ring
42 shaft sleeve
43 centrifugal partition
43A opening
44-1 ring-shaped flange part
45-1 upper surface
46-1 inner peripheral surface
47-1 end face
48-1 upper surface
49-1 insertion part
50, 50-1, 50-2 discharge part
51 motion control part
53 casing
54, 54-1, 54-2 large diameter part
55A suction opening
55B discharge opening
58, 58-1 through hole
59 mounting ring
60 shaft hole
61 boss part
61A outer peripheral surface
62 outer peripheral wall
62A inner peripheral part
63 side wall
63A front surface
63B back surface
69, 69-2 channel loss mitigation space
70, 70-1, 70-2 first turbine impeller (rotating impeller)
71, 71-2 stationary impellers
72 boss part
73, 73-1 turbine impeller part
74 boss part
75 plate-like vane
76 annular part
77 vane
78, 78-1, 78-2 hexagonal bolt
80, 80-1 second turbine impeller (rotating impeller)
81 vane
82 fitting hole
85, 85-2 thrust board
97 discharge-side surface
98 mounting ring

What is claimed is:

1. A turbo vacuum pump comprising:

a suction part that sucks gas in an axial direction;

a discharge part that discharges the gas sucked by the suction part, the discharge part having a plurality of rotating impellers and a stationary impeller arranged so as to be opposed to each of the plurality of rotating impellers; and a rotating shaft that rotates the plurality of rotating impellers, wherein the plurality of rotating impellers include at least one stage of a first turbine impeller for discharging the sucked gas in the axial direction, the first turbine impeller being radially affixed to a boss part, the boss part axially affixed to a suction-part-side end face of the rotating shaft, and at least one stage of a second turbine impeller radially affixed to the rotating shaft that extends through the second turbine impeller, the second turbine impeller being arranged downstream of the first turbine impeller.

2. The turbo vacuum pump according to claim 1, wherein a hollow part is formed in an axial direction in a portion of the rotating shaft which extends through the second turbine impeller.

3. The turbo vacuum pump according to claim 2, wherein the hollow part has an opening that opens at the suction-part-side end face of the rotating shaft, and further comprising a boss for affixing the first turbine impeller to the rotating shaft via the boss, the boss being inserted into the hollow part from the opening.

4. The turbo vacuum pump according to claim 1, wherein the plurality of rotating impellers further include a centrifugal impeller located downstream of the second turbine impeller for further discharging the discharged gas by a centrifugal drag effect.

5. The turbo vacuum pump according to claim 2, wherein the plurality of rotating impellers further include a centrifugal impeller located downstream of the second turbine impeller for further discharging the discharged gas by a centrifugal drag effect.

6. A turbo vacuum pump comprising:

a suction part that sucks gas in an axial direction:

a discharge part that discharges the gas sucked by the suction part, the discharge part having a plurality of rotating impellers and a stationary impeller arranged so as to be opposed to each of the plurality of rotating impellers; and a rotating shaft that rotates the plurality of rotating impellers, wherein the plurality of rotating impellers include at least one stage of a first turbine impeller for discharging the sucked gas in the axial direction, the first turbine impeller being affixed to a suction part side end face of the rotating shaft, and at least one stage of a second turbine impeller affixed to the rotating shaft that extends through the second turbine impeller, the second turbine impeller being arranged downstream of the first turbine impeller, wherein a hollow part is formed in the rotating shaft, the hollow part has an opening that opens at an end face on a side opposite the suction-part-side end face of the rotating shaft, and the opening is formed so as not to communicate with the suction-part-side end face.

7. A turbo vacuum pump comprising:

a suction part that sucks gas in an axial direction;

a discharge part that discharges the gas sucked by the suction part, the discharge part having a plurality of rotating impellers and a stationary impeller arranged so as to be opposed to each of the plurality of rotating impellers; and a rotating shaft that rotates the plurality of rotating impellers having a turbine impeller, and a centrifugal impeller arranged downstream of the turbine impeller, and has a hollow part formed in an axial direction, the hollow part having a depth reaching the portion of a large diameter part arranged immediately downstream of the last stage centrifugal impeller, wherein the plurality of rotating impellers include at least one stage of a turbine impeller for discharging the sucked gas in the axial direction, the turbine impeller being affixed to a suction-part-side end face of the rotating shaft, the hollow part has an opening that opens at the suction-part-side end face of the rotating shaft, and further comprising a boss for axially affixing the first turbine impeller to the rotating shaft via the boss, the boss being inserted into the hollow part from the opening.

8. The turbo vacuum pump according to claim 7, wherein the plurality of rotating impellers further include a centrifugal impeller located downstream of the turbine impeller for further discharging the discharged gas by a centrifugal drag effect.

9. A turbo vacuum pump comprising:

a suction part that sucks gas in an axial direction;

a discharge part that discharges the gas sucked by the suction part, the discharge part having a plurality of rotating impellers and a stationary impeller arranged so as to be opposed to each of the plurality of rotating impellers; and a rotating shaft that rotates the plurality of rotating impellers and has a hollow part formed in an axial direction, wherein the plurality of rotating impellers include at least one stage of a turbine impeller for discharging the sucked gas in the axial direction, the turbine impeller being affixed to a suction-part-side end face of the rotating shaft, the hollow part has an opening that opens at an end face on a side opposite the suction-part-side end face of the rotating shaft, and the opening is formed so as not to communicate with the suction-part-side end face.

10. The turbo vacuum pump according to claim 9, wherein the plurality of rotating impellers further include a centrifugal impeller located downstream of the turbine impeller for further discharging the discharged gas by a centrifugal drag effect.

* * * * *